US011761281B2

(12) United States Patent
Loehken et al.

(10) Patent No.: US 11,761,281 B2
(45) Date of Patent: Sep. 19, 2023

(54) SHAPED POWER CHARGE WITH INTEGRATED INITIATOR

(71) Applicant: DynaEnergetics Europe GmbH, Troisdorf (DE)

(72) Inventors: Joern Olaf Loehken, Troisdorf (DE); Liam McNelis, Bonn (DE); Denis Will, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/641,855

(22) PCT Filed: Sep. 29, 2020

(86) PCT No.: PCT/EP2020/077180
§ 371 (c)(1),
(2) Date: Mar. 10, 2022

(87) PCT Pub. No.: WO2021/063920
PCT Pub. Date: Apr. 8, 2021

(65) Prior Publication Data

US 2022/0325591 A1 Oct. 13, 2022

Related U.S. Application Data

(60) Provisional application No. 62/908,747, filed on Oct. 1, 2019.

(51) Int. Cl.
*E21B 23/06* (2006.01)
*F42B 3/00* (2006.01)

(52) U.S. Cl.
CPC ..... *E21B 23/065* (2013.01); *F42B 3/006* (2013.01)

(58) Field of Classification Search
CPC .. E21B 23/065; E21B 43/263; E21B 23/0414; E21B 23/04; E21B 29/02
See application file for complete search history.

(56) References Cited

U.S. PATENT DOCUMENTS 2,308,004 A 1/1943 Hart
2,428,884 A * 10/1947 Lefren ..... F42B 3/103 174/77 R (Continued)

FOREIGN PATENT DOCUMENTS

CA 2671096 A1 9/2010
CA 2980935 A1 10/2016

(Continued)

OTHER PUBLICATIONS

Baker Hughes, E-4 Wireline Pressure Setting Assembly and BHGE C Firing Heads, Mar. 8, 2018, 16 pages.

(Continued)

*Primary Examiner* — Kipp C Wallace
(74) *Attorney, Agent, or Firm* — Womble Bond Dickinson (US) LLP

(57) ABSTRACT

A power charge for actuating a wellbore tool. Combustion of the power charge generates gas and corresponding gas pressure within the wellbore tool and the power charge and wellbore tool are configured for providing a path to an expansion chamber for the gas pressure. A body of the power charge may have the shape of a regular polygonal cylinder, thus defining flow-paths for the expanding gas. The power charge may include a cylinder of energetic material and an interior space formed within the energetic material and configured for receiving an igniter and/or ignition material. Ignition of the igniter or ignition material results in combustion of the power charge.

18 Claims, 15 Drawing Sheets

(56) References Cited

U.S. PATENT DOCUMENTS 2,618,343 A 11/1952 Conrad
2,644,530 A 7/1953 Baker
2,681,114 A 6/1954 Conrad
2,695,064 A 11/1954 Ragan et al.
2,696,259 A 12/1954 Greene
2,713,910 A 7/1955 Baker et al.
2,769,701 A 11/1956 Frederick
2,799,343 A 7/1957 Conrad
2,807,325 A 9/1957 Webb
2,815,816 A 12/1957 Baker
2,923,204 A * 2/1960 Mohaupt ..... E21B 43/263 175/4.58
3,002,559 A * 10/1961 Hanes ..... E21B 23/065 166/123
3,024,843 A * 3/1962 Hanes ..... E21B 23/065 166/212
3,031,964 A 5/1962 Chesnut
3,036,636 A 5/1962 Clark
3,055,430 A 9/1962 Campbell
3,076,507 A 2/1963 Sweetman
3,094,166 A 6/1963 Mccullough
3,160,209 A 12/1964 Bonner
3,186,485 A 6/1965 Owen
RE25,846 E 8/1965 Campbell
3,233,674 A 2/1966 Kurt
3,264,986 A * 8/1966 Mohaupt ..... F42B 3/00 102/322
3,266,575 A 8/1966 Owen
3,298,437 A 1/1967 Conrad
3,303,884 A 2/1967 Medford
3,398,803 A 8/1968 Kurt et al.
3,498,376 A 3/1970 Sizer et al.
3,669,190 A 6/1972 Sizer et al.
3,691,954 A 9/1972 Kern
3,712,376 A 1/1973 Young et al.
3,762,470 A 10/1973 Eggleston
4,530,396 A * 7/1985 Mohaupt ..... E21B 43/263 166/63
4,535,842 A 8/1985 Ross
4,620,591 A 11/1986 Terrell et al.
4,754,812 A 7/1988 Gentry
4,840,231 A 6/1989 Berzin et al.
4,898,245 A 2/1990 Braddick
5,024,270 A 6/1991 Bostick
5,211,224 A 5/1993 Bouldin
5,316,087 A 5/1994 Manke et al.
5,379,845 A 1/1995 Blount et al.
5,396,951 A 3/1995 Ross
5,447,202 A 9/1995 Littleford
5,732,869 A 3/1998 Hirtl
5,831,204 A 11/1998 Lubben et al.
6,070,662 A 6/2000 Ciglenec et al.
6,164,375 A 12/2000 Carisella
6,272,782 B1 8/2001 Dittrich et al.
6,502,736 B2 1/2003 Dittrich et al.
6,591,753 B1 7/2003 Schmid et al.
6,817,298 B1 * 11/2004 Zharkov ..... F42B 3/04 102/317
6,880,637 B2 4/2005 Myers, Jr. et al.
7,073,589 B2 7/2006 Tiernan et al.
7,104,323 B2 9/2006 Cook et al.
7,228,906 B2 6/2007 Snider et al.
7,278,482 B2 10/2007 Azar
7,779,926 B2 8/2010 Turley et al.
8,336,635 B2 12/2012 Greenlee et al.
8,474,381 B2 7/2013 Streibich et al.
8,522,863 B2 9/2013 Tiernan et al.
8,752,486 B2 6/2014 Robertson et al.
8,826,821 B2 9/2014 Martin
8,931,569 B2 1/2015 Fagley et al.
9,080,405 B2 7/2015 Carisella
9,285,199 B2 3/2016 Beikoff
9,453,381 B2 9/2016 Moyes
9,453,382 B2 9/2016 Carr et al.
9,464,495 B2 10/2016 Picciotti et al.
9,476,272 B2 10/2016 Carisella et al.
9,476,275 B2 10/2016 Wells et al.
9,482,069 B2 11/2016 Powers
9,506,316 B2 11/2016 Carr et al.
9,581,422 B2 2/2017 Preiss et al.
9,587,466 B2 3/2017 Burguieres et al.
9,605,937 B2 3/2017 Eitschberger et al.
9,771,769 B2 9/2017 Baker et al.
9,822,609 B2 11/2017 Wright et al.
9,835,006 B2 12/2017 George et al.
9,835,428 B2 12/2017 Mace et al.
9,890,604 B2 2/2018 Wood et al.
9,995,115 B2 6/2018 Kasperski
10,018,018 B2 7/2018 Cannon et al.
10,107,054 B2 10/2018 Drury et al.
10,151,181 B2 12/2018 Lopez et al.
10,174,595 B2 1/2019 Knight et al.
10,246,961 B2 4/2019 Robertson et al.
10,267,603 B2 4/2019 Marshall et al.
10,365,079 B2 7/2019 Harrington et al.
10,393,482 B2 8/2019 Khatiwada et al.
10,408,025 B2 9/2019 Harrington et al.
10,443,331 B1 10/2019 Andres et al.
10,538,981 B2 1/2020 Covalt et al.
10,605,040 B2 3/2020 Hardesty et al.
10,612,340 B2 4/2020 Snider et al.
10,689,931 B2 6/2020 Mickey et al.
10,767,430 B2 9/2020 Covalt et al.
10,830,566 B2 11/2020 Maxted et al.
10,844,678 B2 11/2020 Mickey et al.
10,858,920 B2 12/2020 Wells
10,883,327 B1 1/2021 Drury et al.
10,900,309 B2 1/2021 Robertson et al.
10,927,627 B2 2/2021 Eitschberger et al.
10,934,795 B2 3/2021 Wells
10,941,625 B2 3/2021 Mickey
11,053,759 B2 7/2021 Covalt et al.
11,053,760 B2 7/2021 Baker et al.
11,053,783 B2 * 7/2021 Montoya Ashton ..... E21B 23/0414
11,255,147 B2 2/2022 Eitschberger et al.
2004/0216868 A1 11/2004 Owen
2007/0227635 A1 * 10/2007 Marlin ..... C06C 9/00 149/87
2009/0223668 A1 9/2009 Smart et al.
2012/0006217 A1 1/2012 Anderson
2014/0251612 A1 9/2014 Powers
2015/0247375 A1 9/2015 Stout
2015/0285019 A1 10/2015 Wood et al.
2016/0053560 A1 2/2016 Drury et al.
2016/0053561 A1 2/2016 Carr et al.
2016/0168942 A1 6/2016 Broome et al.
2016/0186511 A1 6/2016 Coronado et al.
2016/0186513 A1 6/2016 Robertson et al.
2016/0272145 A1 * 9/2016 Weber ..... B60R 21/26
2016/0305208 A1 10/2016 Jacob
2017/0009560 A1 1/2017 Wells
2017/0044865 A1 2/2017 Sabins et al.
2017/0051586 A1 2/2017 Wells et al.
2017/0276465 A1 9/2017 Parks et al.
2018/0080298 A1 3/2018 Covalt et al.
2018/0087330 A1 3/2018 Bradley et al.
2018/0106121 A1 4/2018 Griffin et al.
2018/0163497 A1 6/2018 Younger
2018/0202248 A1 7/2018 Harrington et al.
2018/0202249 A1 * 7/2018 Harrington ..... E21B 23/04
2018/0291700 A1 10/2018 Tu et al.
2019/0017356 A1 1/2019 Harrington et al.
2019/0106956 A1 4/2019 Wells
2019/0106962 A1 4/2019 Lee et al.
2019/0128657 A1 * 5/2019 Harrington ..... F42D 1/045
2019/0162057 A1 5/2019 Montoya Ashton et al.
2019/0277103 A1 * 9/2019 Wells ..... E21B 33/128
2019/0368293 A1 12/2019 Covalt et al.
2020/0018132 A1 1/2020 Ham
2020/0032603 A1 1/2020 Covalt et al.
2020/0095838 A1 3/2020 Baker
2020/0362652 A1 11/2020 Eitschberger et al.

(56) References Cited

U.S. PATENT DOCUMENTS

| | | | |
|---|---|---|---|
| 2020/0362654 | A1 | 11/2020 | Eitschberger et al. |
| 2020/0378731 | A1 | 12/2020 | Mcnelis |
| 2021/0048284 | A1 | 2/2021 | Maxted et al. |
| 2022/0074718 | A1 | 3/2022 | Mcnelis |

FOREIGN PATENT DOCUMENTS

| | | | |
|---|---|---|---|
| CA | 3040116 | A1 | 10/2016 |
| CA | 3022946 | A1 | 11/2017 |
| CA | 3050712 | A1 | 7/2018 |
| CA | 2980935 | C | 11/2019 |
| CA | 2848060 | C | 2/2021 |
| EP | 679859 | A2 | 11/1995 |
| EP | 3277913 | A1 | 2/2018 |
| GB | 2533822 | A | 7/2016 |
| GB | 2537749 | B | 3/2017 |
| RU | 2087693 | C1 | 8/1997 |
| WO | 1994009246 | A1 | 4/1994 |
| WO | 2000020821 | A1 | 4/2000 |
| WO | 2014178725 | A1 | 11/2014 |
| WO | 2016161379 | A1 | 10/2016 |
| WO | 2017125745 | A1 | 7/2017 |
| WO | 2017192878 | A1 | 11/2017 |
| WO | 2018136808 | A1 | 7/2018 |
| WO | 2018213768 | A1 | 11/2018 |
| WO | 2019071027 | A1 | 4/2019 |
| WO | 2019165286 | A1 | 8/2019 |
| WO | 2020244895 | A1 | 12/2020 |
| WO | 2021030594 | A1 | 2/2021 |
| WO | 2021063920 | A1 | 4/2021 |
| WO | 2021113758 | A1 | 6/2021 |

OTHER PUBLICATIONS

Baker Hughes; Power charge, Slow set, Size 10 E4; dated Sep. 18, 2020; https://www.shopbakerhughes.com/wireline/power-charge-slow-set-size-10-e4-h437660010.html; 4 pages.

Baker Hughes; Power charge, Standard, Size 20 E4; dated Sep. 20, 2020; https://www.shopbakerhughes.com/wireline/power-charge-standard-size-20-e4-h437643223.html; 4 pages.

Hunting Titan, T-Set Setting Tool Product Catalog, 2015, 87 pgs., http://www.hunting-intl.com/media/1872254/AMG-1054.HT_T-Set_Catalog_LowRes.pdf.

Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.

Hunting, T-Set® Family of Setting Tools, 2 pages.

United States Patent and Trademark Office; Notice of Allowance for U.S. Appl. No. 16/924,504; dated Nov. 5, 2021; 5 pages.

International Searching Authority, International Search Report for International App No. PCT/EP2020/063214, dated Jul. 29, 2020, 17 pages.

International Searching Authority; International Preliminary Report on Patentability of the International Searching Authority for PCT/EP2020/063214; dated Nov. 25, 2021; 12 pages.

International Searching Authority; International Search Report and Written Opinion of the International Searching Authority for PCT/EP2020/077180; dated Jan. 28, 2021; 13 pages.

Lehr, Doug; Declaration of Doug Lehr in Supprt of Repeat Precision's Response Claim Construction Brief; dated Oct. 27, 2021; 35 pages.

Repeat Precision, LLC; Plaintiff Repeat Precision, LLC's Responsive Claim Construction Brief for Civil Action No. 6:21-cv-104-ADA, Public Version; dated Oct. 27, 2021; 21 pages.

Schlumberger, CPST Pressure Setting Tool, 2014, 1 pg., https://www.slb.com/-/media/files/co/product-sheet/cpst-pressure-setting-tool.

United States Patent and Trademark Office, Office Action of U.S. Appl. No. 16/858,041, dated Jun. 16, 2020, 11 pgs.

United States Patent and Trademark Office; Non Final Office Action for U.S. Appl. No. 16/886,257; dated Jan. 15, 2021; 7 pages.

United States Patent and Trademark Office; Notice of Allowance for U.S. Appl. No. 16/858,041; dated Oct. 22, 2020; 10 pages.

United States Patent and Trademark Office; Notice of Allowance for U.S. Appl. No. 16/886,257; dated Sep. 15, 2021; 9 pages.

International Searching Authority; International Preliminary Report on Patentability of the International Searching Authority for PCT/EP2020/077180; dated Apr. 5, 2022; 8 pages.

SPEX Group; SPEX Bridge Plugs & Setting Tools; Jan. 12, 2017; 3 pages.

United States Patent and Trademark Office; Non-Final Office Action for U.S. Appl. No. 17/524,837; dated Sep. 23, 2022; 7 pages.

* cited by examiner

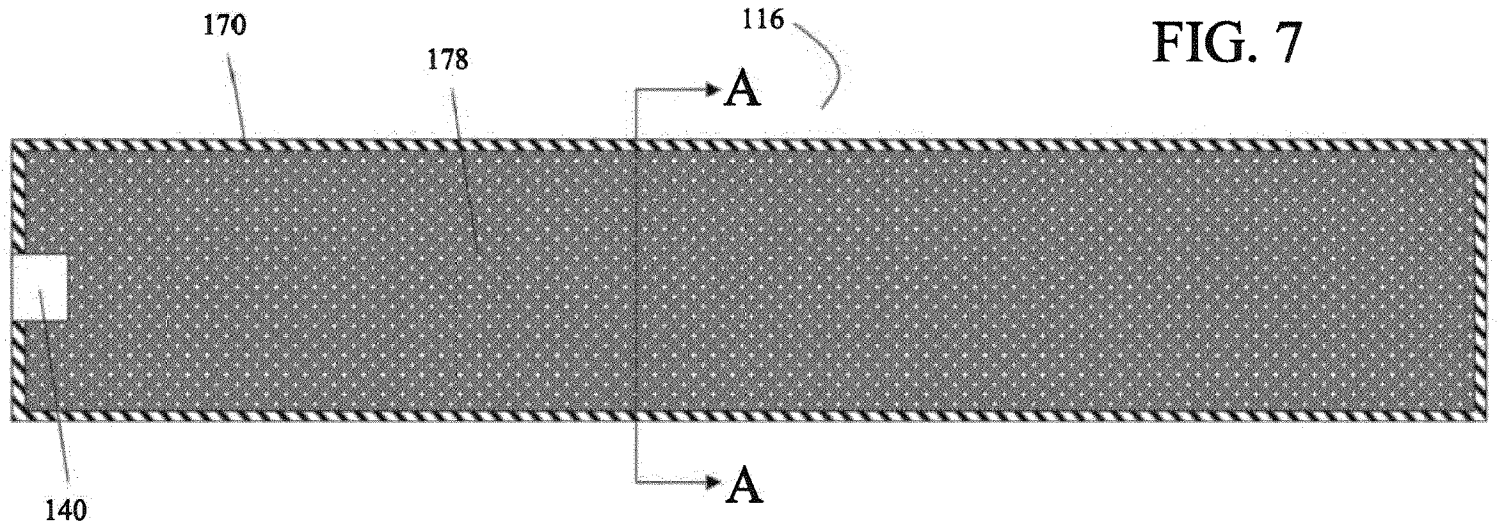
FIG. 7
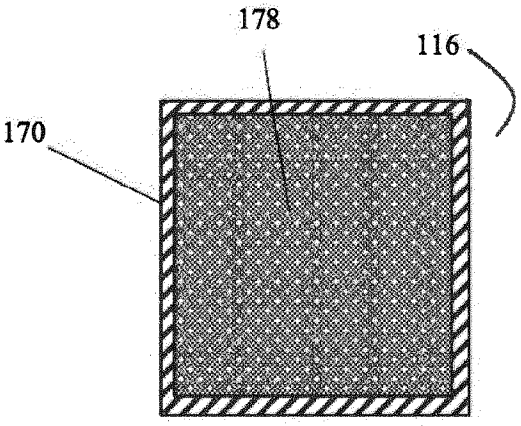
FIG. 7A3
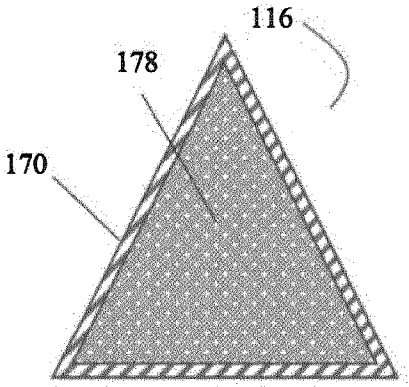
FIG. 7A2
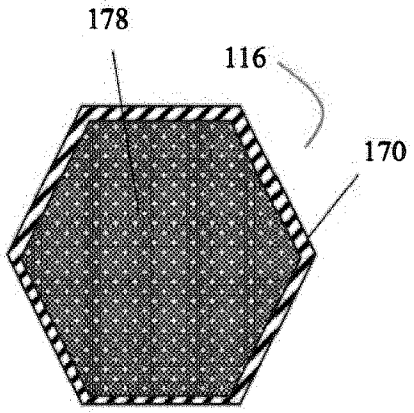
FIG. 7A1

SHAPED POWER CHARGE WITH INTEGRATED INITIATOR

CROSS-REFERENCE TO RELATED APPLICATIONS

This application is a national stage application of and claims priority to Patent Cooperation Treaty (PCT) Application No. PCT/EP2020/077180 filed Sep. 29, 2020, which claims the benefit of U.S. Provisional Patent Application No. 62/908,747 filed Oct. 1, 2019, each of which is incorporated herein by reference in its entirety.

BACKGROUND OF THE DISCLOSURE

Oil and gas are extracted by subterranean drilling and introduction of tools into the resultant wellbore for performing various functions. The work performed by tools introduced in a wellbore may be achieved by a force exerted by expanding gases; the expanding gases may be the result of deflagration of an energetic material.

One example of a wellbore tool is a setting tool. Among other functions, a setting tool is utilized to place plugs at locations inside the wellbore to seal portions of the wellbore from other portions. The force exerted to set a plug is typically exerted on a piston in the setting tool, with the piston acting to deform or displace portions of the plug which then engage the walls of the wellbore. The engagement of the wellbore wall by the deformed portions of the plug hold the plug, as well as any elements attached to the plug, stationary in the wellbore. The plug and any associated elements may completely or partially seal the wellbore, and the associated elements may function to vary this complete/partial blockage depending upon circumstances.

Primarily used during completion or well intervention, a plug may pressure isolate a part of the wellbore from another part. For example, when work is carried out on an upper section of the well, the lower part of the wellbore must be isolated and plugged; this is referred to as zonal isolation. Plugs can be temporary or permanent. Temporary plugs can be retrieved whereas permanent plugs may typically only be removed by destroying them, e.g., with a drill. There are a number of types of plugs, e.g., bridge plugs, cement plugs, frac plugs and disappearing plugs. Plugs may be set using conveyance methods such as a wire-line, coiled tubing, drill pipe or untethered drones. In a typical operation, a plug can be conveyed into a well and positioned at a desired location in the wellbore. A setting tool may be attached to and lowered along with the plug or it may be lowered after the plug, into an operative association therewith.

The expanding gases in a tool typically result from a chemical reaction involving a power charge. In the example of a setting tool, activation of the chemical reaction in the power charge results in a substantial force being exerted on the setting tool piston. When it is desired to set the plug, the self-sustaining chemical reaction in the power charge is initiated, resulting in expanding gas exerting a force on the piston. The piston being constrained to movement in a single direction, the force causes the piston to move axially and actuate the plug to seal a desired area of the well. The force exerted by the power charge on the piston can also shear one or more shear pins, shear threads or similar frangible members that serve certain functions, e.g., holding the piston in place prior to activation and separating the setting tool from the plug.

The force applied to a tool by the power charge should be controlled and it must be sufficient to actuate the tool reliably but not so excessive as to damage the downhole tools or the wellbore itself. Also, even a very strong force can fail to properly actuate a tool if delivered over too short a time duration. Even if a strong force over a short time duration will actuate a tool, such a set-up is often not ideal. That is, a power charge configured to provide force over a period of a few seconds or tens of seconds instead of a few milliseconds is sometimes the required or desired option. In the context of a setting tool, such an actuation is referred to as a "slow set". Depending on the particular function of a given tool and other parameters, favorable force characteristics may be provided by a force achieving work over a period of milliseconds, several seconds or even longer.

FIG. 1 shows a power charge 62 contained in a prior art generic wellbore tool 60. A chemical reaction in power charge 62 results in expanding gas exerting a force 86 on a piston 80 or other force transferring element. The piston 80, in turn, exerts an actuation force 84 to accomplish a function of the generic tool 60. Initiation of the chemical reaction, e.g., combustion, begins at a section of power charge 62 remote from piston 80 and the chemical reaction proceeds in a direction 88 toward piston 80. A problem in the prior art is that the portion of the power charge 62 that has not undergone the chemical reaction may block the expanding gas from exerting force 86 on the piston 80. Thus, expanding gas pressure will increase until it is able to exert a force on the piston 80 and begin moving the piston 80 to exert the actuation force 84 to achieve the function of the generic tool 60. The pressure built up prior to the expanding gas having access to the piston 80 may thus exert a very strong initial force on the piston and defeat the purpose of a slow-set actuation or make such a slow-set actuation a more complicated engineering challenge.

In view of the disadvantages associated with currently available power charges, there is a need for a safe, predictable and economical power charge for use in wellbore tools. The improved power charge will reduce extraneous forces developed during the chemical reaction, i.e., a much-improved force/time profile will be achieved. Such improvements may result in smaller power charges being required and reduced maximum forces within the tool; both of these results will reduce the likelihood of inadvertent damage to the tool.

BRIEF DESCRIPTION

According to an aspect, the exemplary embodiments include a power charge for actuating a tool in a wellbore. The power charge includes a power charge body that defines a cylindrical volume of an energetic material having a proximal end and a distal end. The power charge body also has an interior space extending from the proximal end toward the distal end. An igniter can occupy the interior space of the power charge body such that the power charge substantially encompasses the igniter except for a portion of the igniter head. The igniter has an igniter head configured to receive an electronic signal and an igniter shell containing a fuse head. The fuse head is configured to receive the electronic signal from the igniter head either directly or via an electronics board and includes a pyrotechnic material. The electronic signal is sufficient to ignite the pyrotechnic material and the igniter shell is configured such that the burning of its contents results in a deflagration reaction in the power charge.

The interior space may optionally include an enlarged space configured to encompass the igniter head except for a surface of the igniter head configured to receive the electronic signal. In addition, the interior space and the igniter may extend about 15% to about 75% of a length of the power charge body. Alternatively, the interior space and the igniter may extend substantially the full length of the power charge body.

According to an embodiment, the power charge body may have a non-circular cross-sectional shape. For example, the cross-sectional shape may be a regular polygon. In addition, the power charge may be encompassed by a power charge container.

According to an embodiment, a wellbore tool includes a power charge comprising a cylinder of energetic material defining a cylindrical axis, the cylinder having a proximal end and a distal end, wherein a cross-sectional shape of the cylinder perpendicular to the cylindrical axis is a regular polygon. The wellbore tool also has a power charge cavity, into which the power charge is disposed and an expansion chamber. A fluid flow path is provided from the power charge cavity to the expansion chamber. The fluid flow path includes a diverter channel portion. The wellbore tool may also include an igniter comprising an igniter head and an igniter shell. The igniter head receives an electronic signal to be based to a fuse head in the igniter shell, either directly or via an electrical relay. The igniter shell may be embedded within the cylinder of energetic material adjacent the proximal end of the cylinder of energetic material.

According to an embodiment, a power charge for actuating a tool in a wellbore includes a power charge body comprising energetic material, the power charge body having a proximal end and a distal end. The power charge also includes a booster charge and a booster holder ring disposed in the energetic material of the power charge body at the proximal end thereof, the booster holder ring including a holder configured to hold the booster charge inside the booster holder ring. The booster charge is configured to deflagrate as a result of ignition of an igniter adjacent the proximal end of the power charge body and the deflagration of the booster charge results in deflagration of the energetic material of the power charge body.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which:

FIG. 7 is a cross-sectional, side, plan view of a power charge in accordance with an exemplary embodiment;

FIG. 7A1 is a cross-sectional view of the power charge of FIG. 7 at line A-A in accordance with an exemplary embodiment where the power charge is a hexagonal cylinder;

FIG. 7A2 is a cross-sectional view of the power charge of FIG. 7 at line A-A in accordance with an exemplary embodiment where the power charge is a triangular cylinder;

FIG. 7A3 is a cross-sectional view of the power charge of FIG. 7 at line A-A in accordance with an exemplary embodiment where the power charge is a square cylinder;

Figure 1:
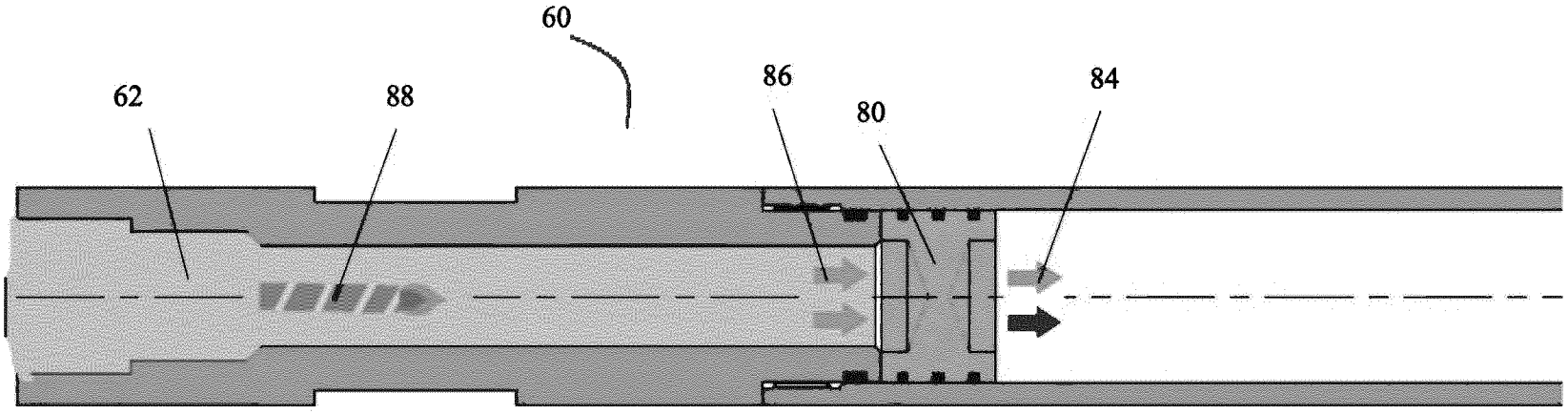
FIG. 1 (Prior Art)
FIG. 1 is a cross-sectional, side, plan view of a generic prior art wellbore tool that utilizes a power charge to perform work.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Figure 2:
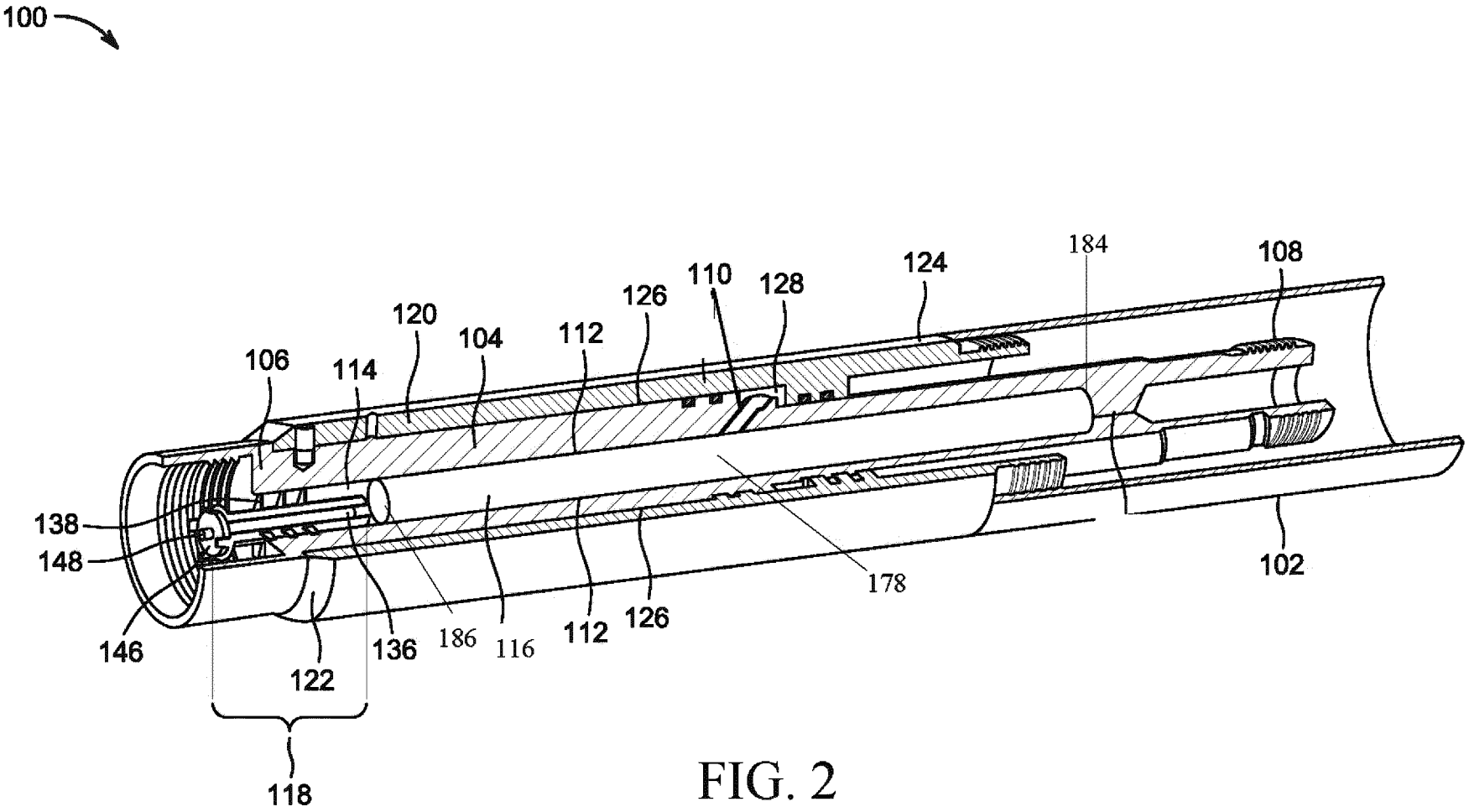
FIG. 2 is a one-quarter-sectional, side, perspective view of a setting tool in accordance with an exemplary embodiment.

FIG. 2 illustrates a perspective, partial quarter-sectional view of a setting tool 100 for actuating a tool 102. The setting tool 100 includes an inner piston 104 having a proximal end 106 and a distal end 108. A section of the inner piston 104 between the proximal end 106 and distal end 108 has an annular wall 112 defining a cavity 114. The cavity 114 is configured to receive a power charge 116 therein, the power charge has a body 178, a proximal end 186 and a distal end 184. The power charge 116 is not shown in quarter-section in FIG. 2, i.e., FIG. 2 shows the external surface of the power charge 116. An igniter 118 is positioned adjacent the proximal end 186 of the power charge 116. The igniter 118 begins the reaction, e.g., combustion, of the power charge 116 to form a combustion gas pressure inside the cavity 114.

The setting tool 100 also has an outer sleeve 120 having a proximal end 122, a distal end 124 and a central bore 126. The outer sleeve 120 is configured to slideably receive the inner piston 104. A generally annular expansion chamber 128 may be defined by a portion of the central bore 126 of the outer sleeve 120 and a portion of the annular wall 112 of the inner piston 104. A gas diverter channel 110 extends through the annular wall 112 of the inner piston 104. The gas diverter channel 110 is configured to allow gas pressure communication between the cavity 114 containing power charge 116 and the expansion chamber 128. Accordingly, in the circumstance where the combusting portion of the power charge 116 has an unimpeded gas pressure path to channel 110, the combustion gas will pass through the gas diverter channel 110 and into the expansion chamber 128. Increasing amounts of gaseous combustion products from burning power charge 116 will increase the pressure in the cavity 114, the gas diverter channel 110 and the expansion chamber 128.

Expansion chamber 128 is so named because it is adapted to expand in volume as a result of axial movement of the outer sleeve 120 relative to the inner piston 104. Increasing gas pressure in the expansion chamber 128 will exert an axial force on outer sleeve 120 and inner piston 104, resulting in the outer sleeve 120 sliding axially toward tool 102 and expansion chamber 128 increasing in volume.

As illustrated in FIG. 2, the igniter 118 includes an igniter head 146 and an igniter shell 136. Igniter head 146 includes an electrically contactable line-in portion 148 through which electrical signals may be conveyed to an electronic circuit board contained in the igniter shell 136, the circuit board and other contents of the igniter shell 136 are discussed further hereinbelow. It is important that igniter 118 be firmly held in place so that its line-in portion 148 may be accessed. Further, the position of the igniter 118 adjacent the proximal end 186 of the power charge 116 is important so that it can effectively begin the combustion reaction of the power charge 116 to form a combustion gas pressure inside the cavity 114. An igniter holder 138 is shown in FIG. 2 that assures the proper position of the igniter 118. The igniter holder 138 shown receives the igniter shell 136 in a central bore and also engages the igniter head 146. The igniter holder also engages the annular wall 112 of cavity 114 adjacent the proximal end 106 of piston 104 in order to maintain its position inside the setting tool 100.

Figure 3:
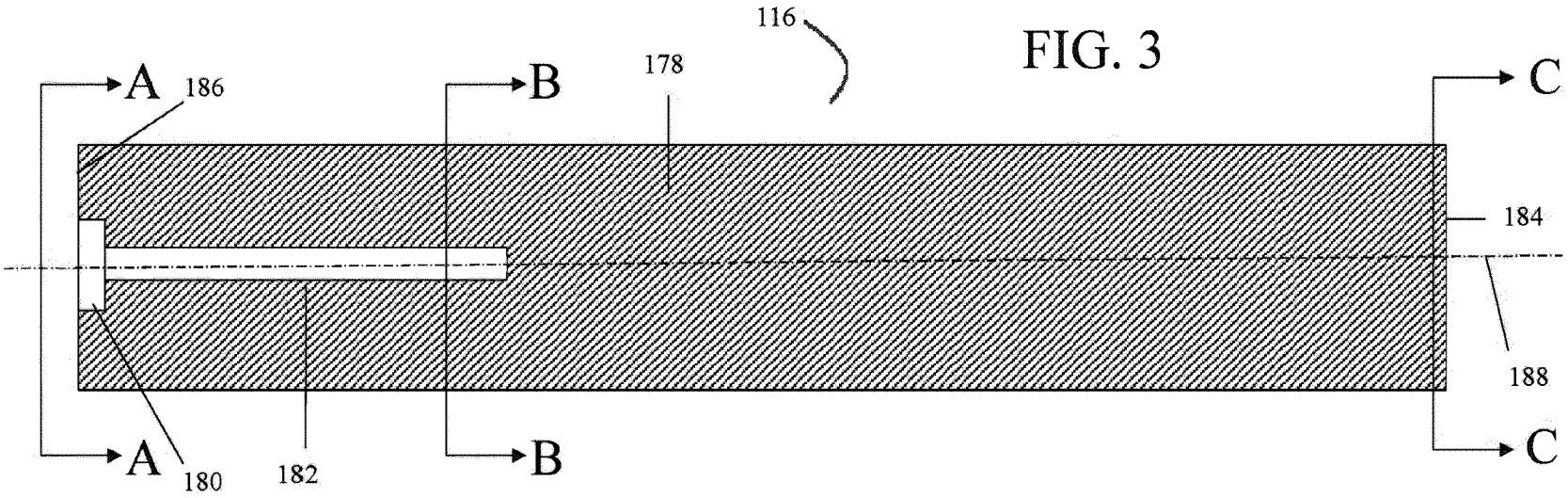
FIG. 3 is a cross-sectional, side, plan view of a power charge in accordance with an exemplary embodiment.
Figure 3C:
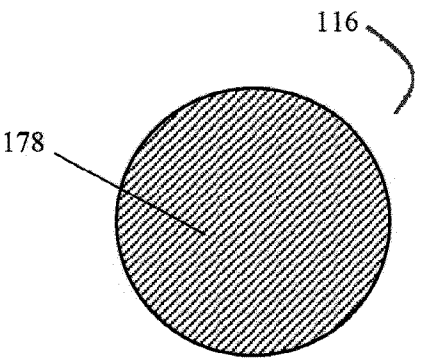
FIG. 3C is a cross-sectional view of the power charge of FIG. 3 taken at line C-C.
Figure 3B:
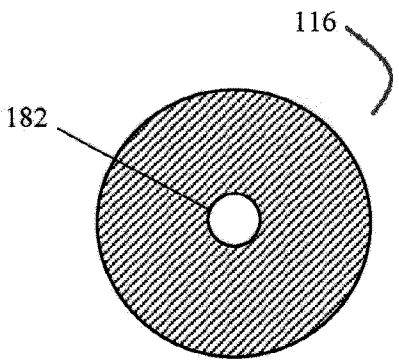
FIG. 3B is a cross-sectional view of the power charge of FIG. 3 taken at line B-B.
Figure 3A:
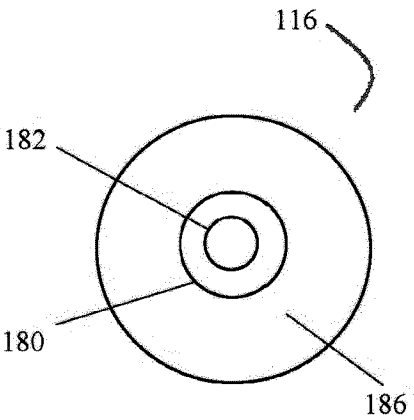
FIG. 3A is a plan view of the proximal end of the power charge of FIG. 3 taken at line A-A.

In an embodiment, igniter holder 138 may be eliminated from the setting tool 100; such elimination means that the portion of the piston 104 needed to house the igniter holder 138 may also be eliminated. FIG. 3 illustrates a power charge 116 in which an igniter shell space 182 and an igniter head space 180 are formed in the power charge body 178, extending from the proximal end 186 of the power charge 116. FIG. 4 illustrates the igniter 118 occupying the igniter shell space 182 and igniter head space 180. The exemplary embodiments shown in FIG. 3 and FIG. 4 may allow for a reduced overall length of the setting tool 100, by the length of the igniter 118. In addition, since the fuse head 176 and the main load 172 are typically located adjacent the distal end of the igniter 118, the chemical reaction initiated by the fuse head portion of the igniter 118 begins within the power charge body 178 instead of adjacent the proximal end 186 of the power charge 116. Thus, the reliability of initiation of the reaction/combustion of the power charge 116 by the igniter may be enhanced.

Integrating the igniter 118 within the power charge body 178 according to the exemplary embodiment shown in FIG. 4 begins combustion of the power charge 116 at a point closer to the gas diverter channel 110. Thus, expanding gases developed by the combustion of power charge 116 may have an unimpeded path to gas diverter channel 110, to enter expansion chamber 128 and actuate the setting tool 100. The exemplary arrangement may reduce the amount of uncombusted power charge body 178 that would otherwise block the path. By advancing the combustion initiation axially along the power charge 116, the portion of the power charge body 178 that could potentially impede the flow-path of expanding gas is reduced by the portion of the body between the point of initiation and the proximal end 186 of the power charge 116.

Figure 4A:
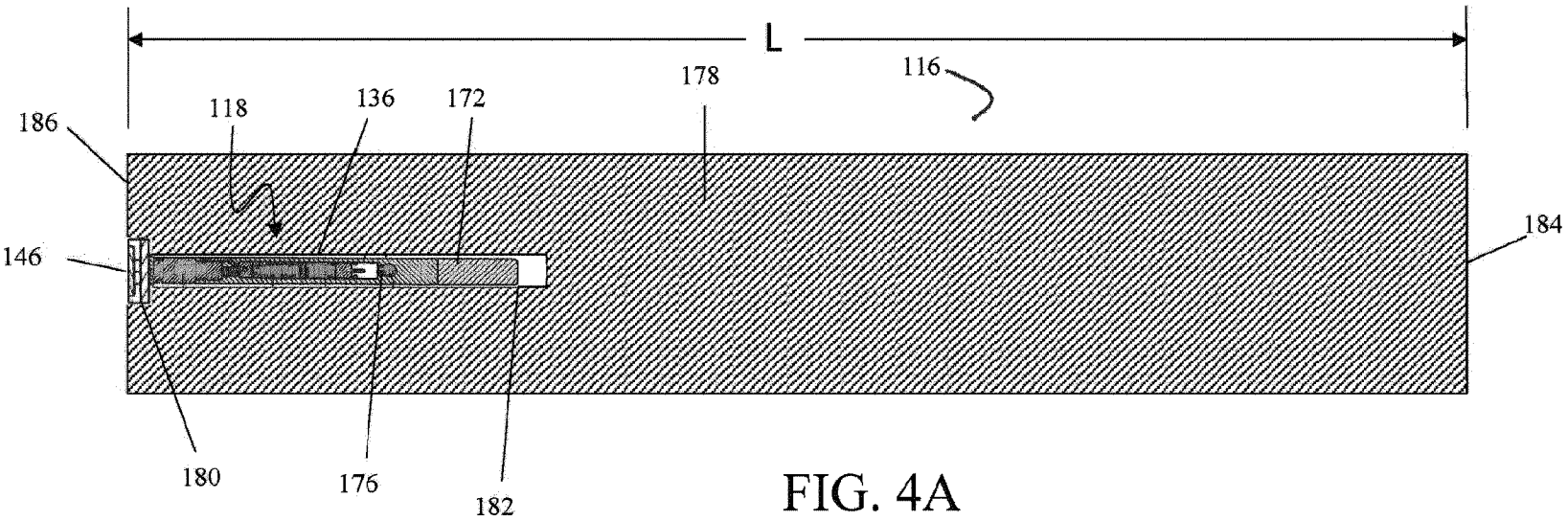
FIG. 4A is a cross-sectional, side, plan view of the power charge of FIG. 3 with an igniter inserted therein, according to an exemplary embodiment.
Figure 4C:
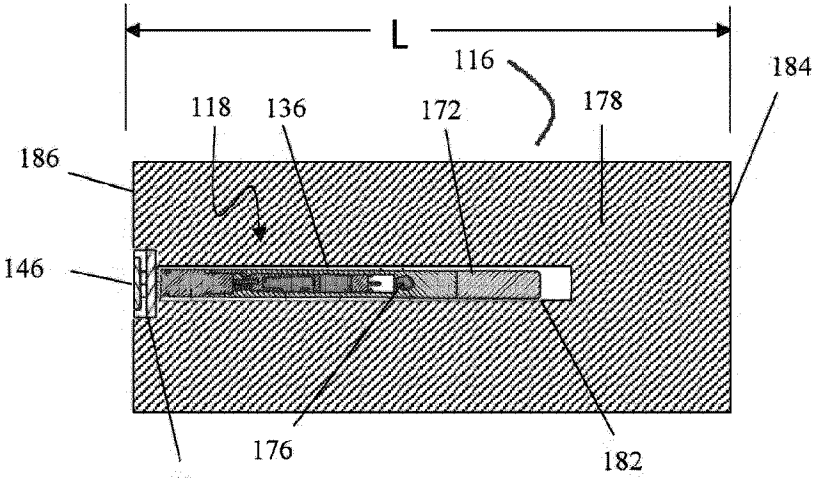
FIG. 4C is a cross-sectional, side, plan view of a power charge and igniter according to an exemplary embodiment.
Figure 4B:
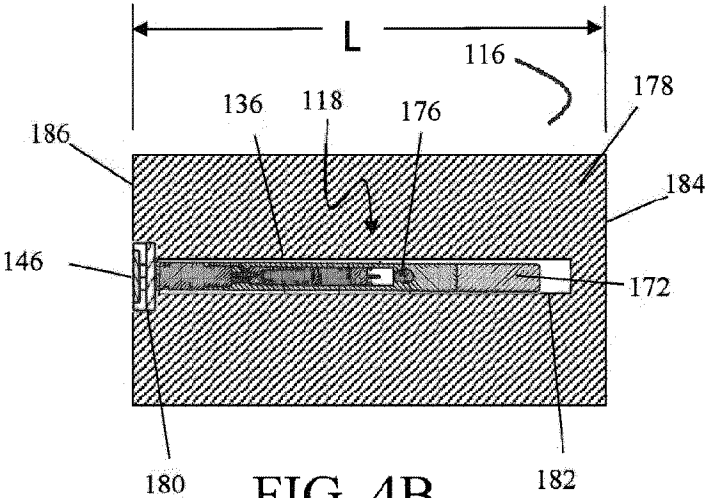
FIG. 4B is a cross-sectional, side, plan view of a power charge and igniter according to an exemplary embodiment.

FIGS. 4A, 4B and 4C illustrate how the portion of the power charge body 178 impeding the flow-path of the combustion gases to the diverter channel 110 may be varied with an integrated igniter. The reaction/combustion in igniter 118 is transferred to the power charge 116 through combustion of the main load 172 of the igniter 118. Thus, as shown in FIG. 4A, combustion of the power charge 116 will begin approximately 15% of the way along length L of the power charge 116. This is because the igniter 118 extends approximately 15% of the length L between the proximal end 186 and the distal end 184 of the power charge 116 in FIG. 4A. FIG. 4B illustrates an exemplary embodiment where the igniter shell space 182 and igniter 118 extend substantially the entirety of the length L between the proximal end 186 and the distal end 184 of the power charge 116. After deflagration begins in the power charge 116 of FIG. 4B, it may be a relatively short time before a flow-path is opened for the combustions gases to reach gas diverter channel 110. This is because a relatively small volume of power charge body 178 is between the main load 172 of the igniter 118 and the distal end 184 of the power charge 116 when the main load 172 begins combusting. FIG. 4C shows an exemplary embodiment where the igniter shell space 182 and igniter 118 extend approximately 75% of the length L of the illustrated power charge 116.

Each of the power charges 116 in FIGS. 4A, 4B and 4C have an igniter head space 180 formed in the power charge body 178 that receives the igniter head 146. The igniter head space 180 in these figures is sized so that the igniter head 146 is approximately flush with the power charge proximal end 186. The igniter head space 180 may also be sized such that the igniter head 146 is only partially embedded in the power charge body 178 or sized so that the igniter head 146 is sunk below the level of power charge proximal end 186.

Figure 5:
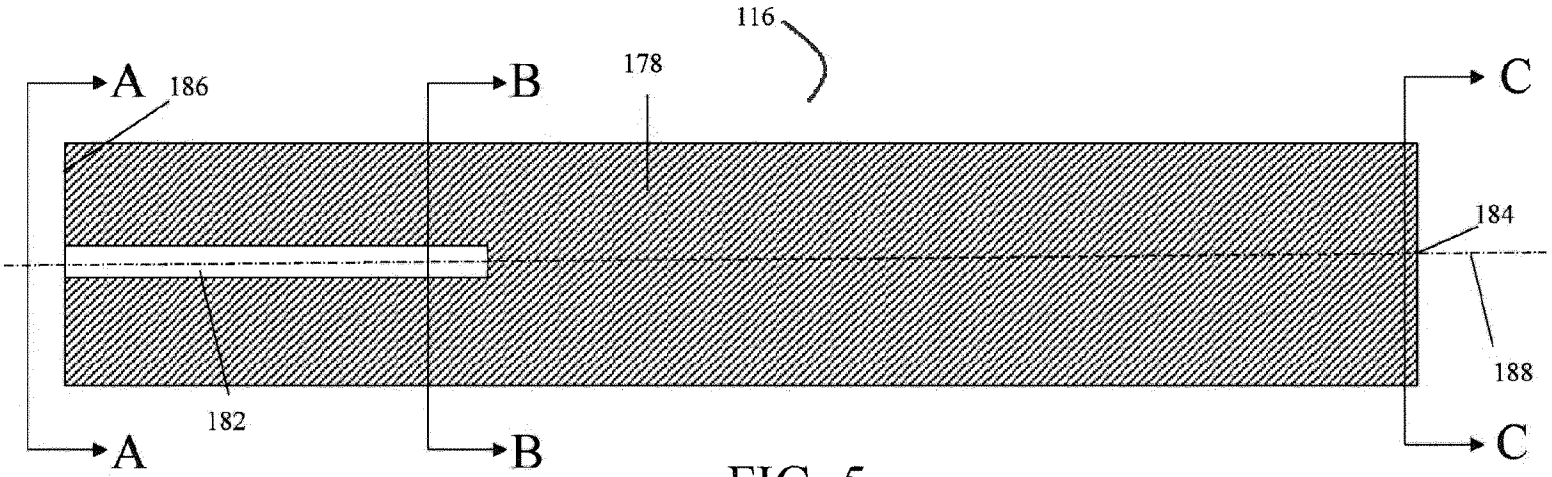
FIG. 5 is a cross-sectional, side, plan view of a power charge in accordance with an exemplary embodiment.
Figure 5C:
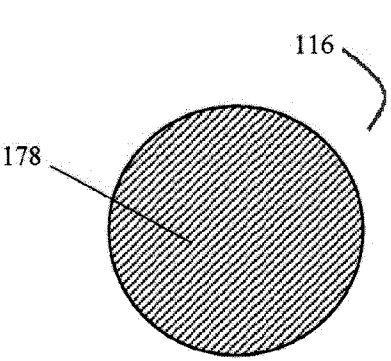
FIG. 5C is a cross-sectional view of the power charge of FIG. 5 taken at line C-C.
Figure 5B:
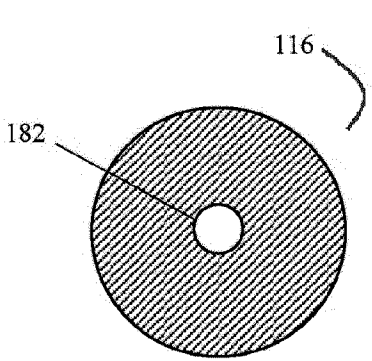
FIG. 5B is a cross-sectional view of the power charge of FIG. 5 taken at line B-B.
Figure 5A:
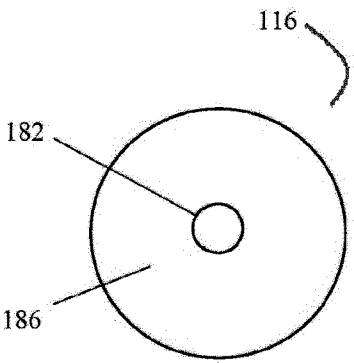
FIG. 5A is a plan view of the proximal end of the power charge of FIG. 5 taken at line A-A.
Figure 6:
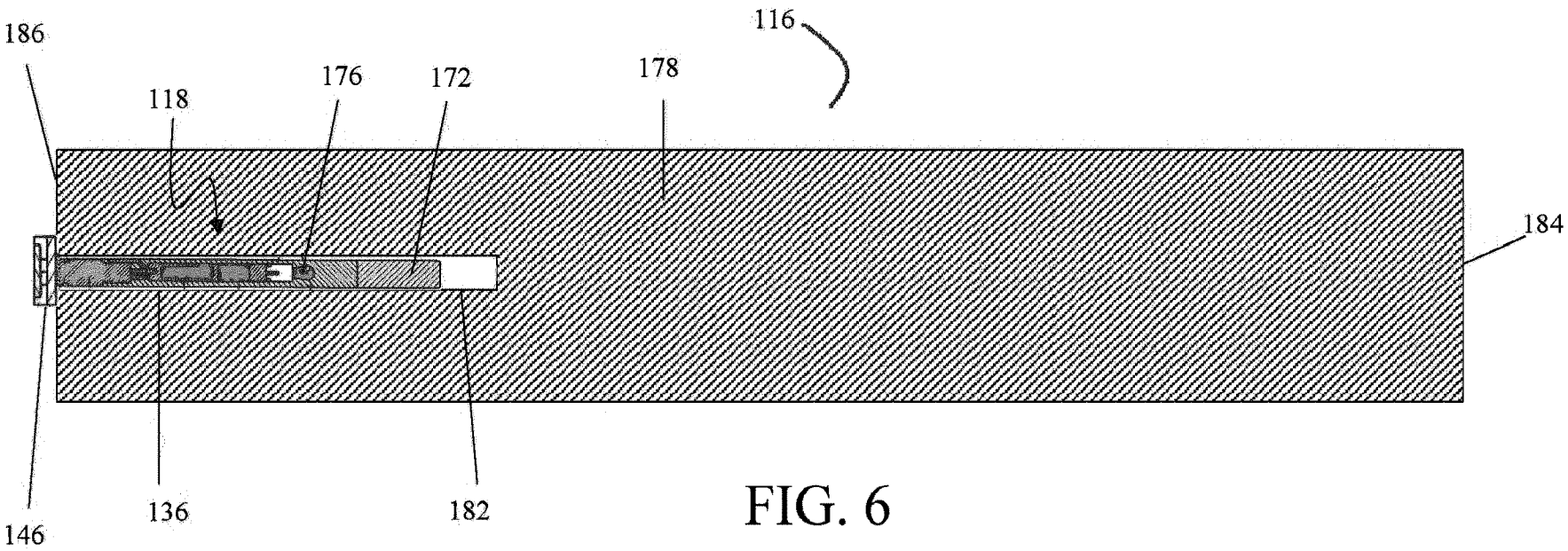
FIG. 6 is a cross-sectional, side, plan view of the power charge of FIG. 5 with an igniter inserted therein according to an exemplary embodiment.

In an exemplary embodiment shown in FIGS. 5 and 6, no igniter head space 180 is provided in the power charge body 178. Thus, while the igniter shell 136 is received within the power charge body 178, the igniter head 146 is completely outside the power charge body 178, adjacent the power charge proximal end 186. The distance to which the igniter shell space 182 extends toward the power charge distal end 184 need not be dependent on whether an igniter head space 180 is provided in a given power charge 116.

Further to the geometry of the igniter shell space 182 and igniter head space 180, FIGS. 3-6 show these spaces as coaxial with the main axis 188 of the power charge body 178. This, however, is not limiting. It is contemplated that the igniter shell space 182 and, if present, igniter head space 180 may be offset radially from the main axis 188 by any distance up to the radius of the power charge body 178.

With reference again to FIG. 2, the annular wall 112 in a setting tool 100 typically has the shape of a round cylinder. Thus, cavity 114 has the shape of a round cylinder and the round cylindrical power charges 116 illustrated in FIGS. 3-6 may be sized to fit snugly within cavity 114. FIG. 7 illustrates a power charge 116 having a cross-section other than round. Each of FIGS. 7A1, 7A2 and 7A3 show a cross-section taken at line A-A of FIG. 7 for a different shaped power charge 116. Examples include a hexagonal cross-section shown in FIG. 7A1, a triangular cross-section shown in FIG. 7A2 and a square cross-section shown in FIG. 7A3. The dimensions of the non-circular cross-section power charges 116 are selected such that they still fit snugly within the cavity 114. That is, as shown in FIG. 9A, the square cross-section power charge 116 of FIG. 7A3 fits snugly within the cavity 114 of the exemplary setting tool shown in FIG. 9. Any cylinder with a regular polygon cross-section, like the three shown in FIGS. 7A1, 7A2 and 7A3, may be dimensioned to fit snugly in a round cylindrical cavity 114.

FIG. 7 also shows an indentation 140 at the proximal end of the power charge 116. The indentation 140 may enhance ignition of the power charge 116 in exemplary embodiments in which the igniter 118 is not inserted in the body 178 of power charge 116 but, instead, is located adjacent the proximal (igniter) end 186 of the power charge 116, as shown in FIG. 2. By providing a slight offset between the igniter 118 and the surface of power charge 116, the indentation 140 may enhance initiation of the combustion of the power charge 116. Further, indentation 140 may be filled or lined with a booster charge (not shown), the chemical makeup of the booster charge may be more sensitive to initiation than the chemical makeup of the power charge 116.

Figure 9:
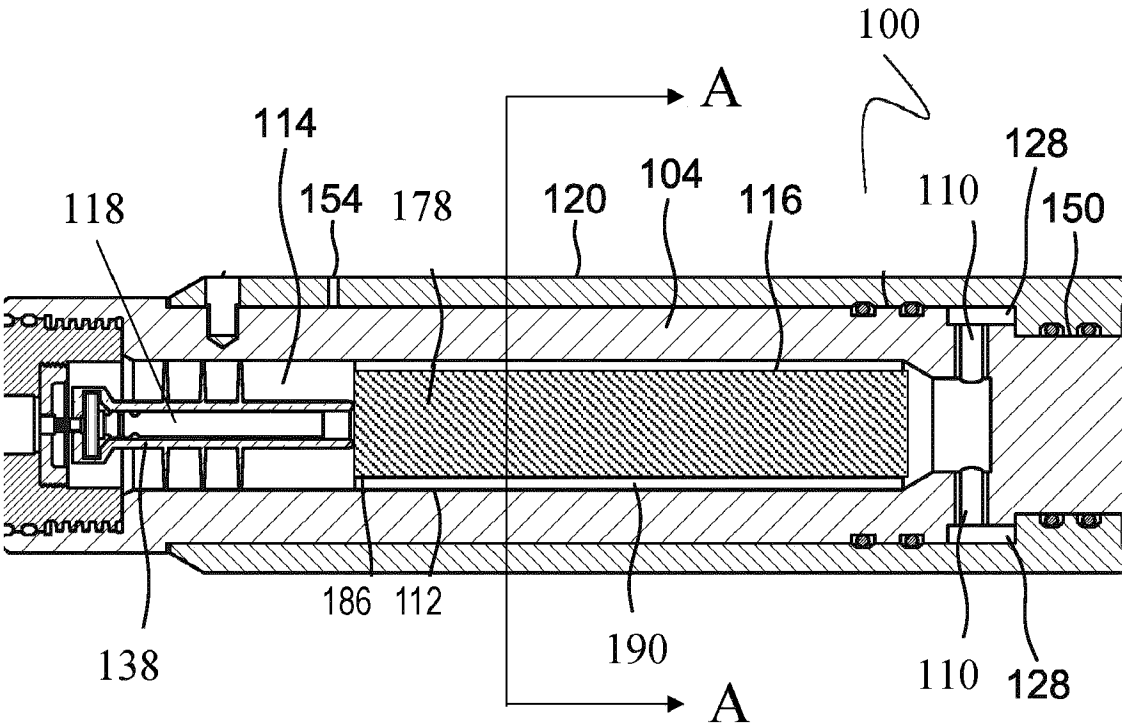
FIG. 9 is a cross-sectional, side view of a portion of a setting tool in accordance with an exemplary embodiment.
Figure 9A:
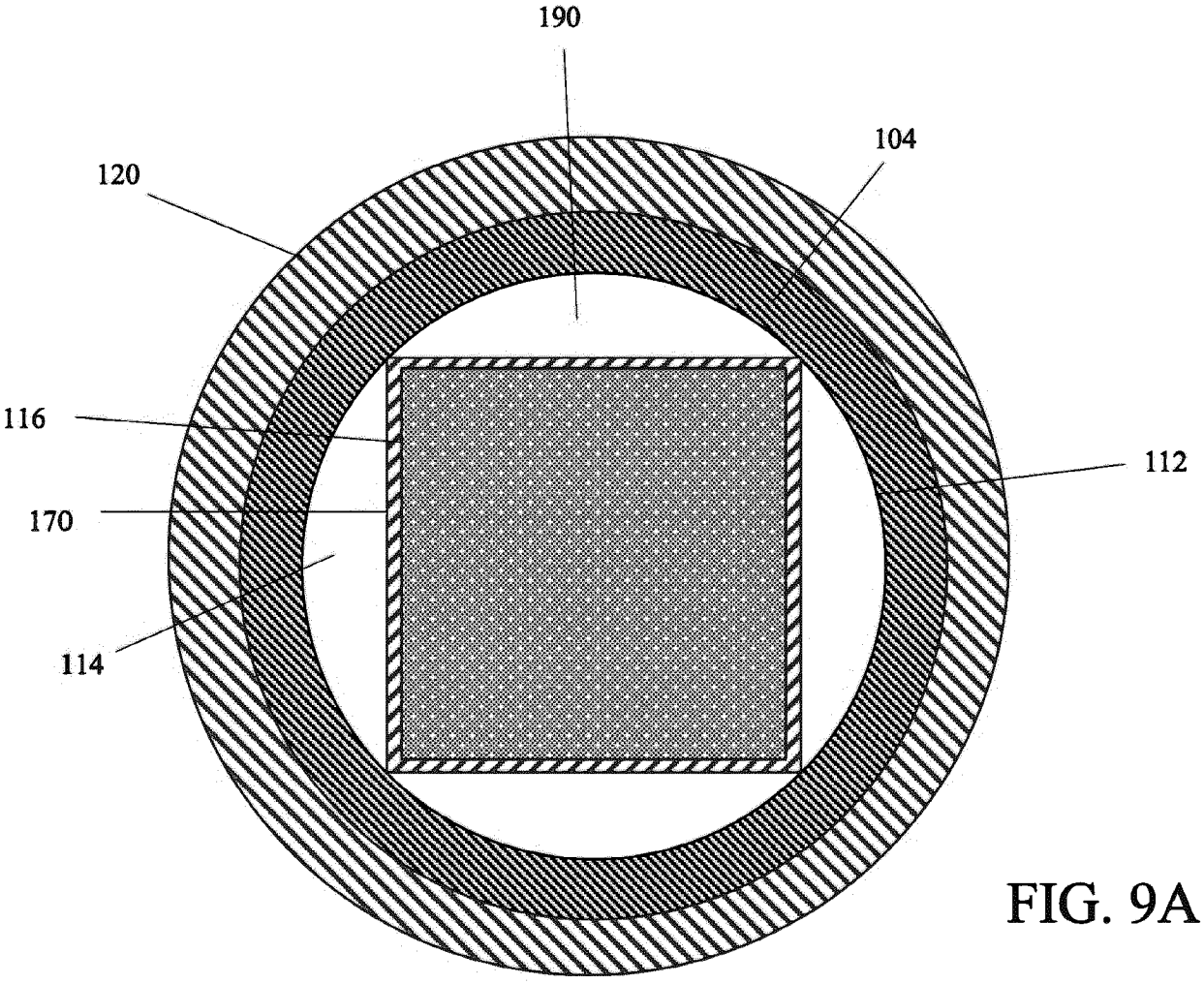
FIG. 9A is a cross-sectional view of the setting tool shown in FIG. 9 taken along line A-A.

FIG. 9 is a cross-section detail of the cavity 114 portion of an exemplary embodiment of the setting tool 100. The exemplary embodiment of setting tool 100 illustrated in FIG. 9 includes the outer sleeve 120, the inner piston 104 and its annular wall 112 enclosing the cavity 114, as previously discussed. The cavity 114 is configured to receive the power charge 116. The exemplary embodiment of FIG. 9 further includes gas diverter channels 110 and the expansion chamber 128 as previously discussed, though in slightly modified form. For example, the gas diverter channels 110 extend perpendicularly to the cavity 114.

FIG. 9A is a cross-section of the setting tool 100 of FIG. 9 taken at line A-A. Where the power charge 116 has the cross-section of a regular polygon, e.g., square as in FIG. 9A, the portions of cavity 114 not occupied by the power charge 116 form gas flow channels 190 that extend axially along the length of cavity 114. Expanding combustion gas resulting from the chemical reaction, e.g., combustion, of the power charge 116 is able to flow into and axially through these gas flow channels 190. The gas flow channels 190 provide additional paths for combustion gas to access the gas diverter channels 110 and the expansion chamber 128, especially in the case where uncombusted portions 116 of the power charge 116 may block other flow paths. The gas flow channels 190 also provide a path to the gas diverter channels 110 and the expansion chamber 128 during early stages of combustion of the power charge 116, which may provide a more gradual increase in the pressure within the expansion chamber 128 and slow-set options for the setting tool 100.

The regular polygonal power charge 116 may be initiated by an igniter 118 external to the power charge body 178, as illustrated in FIGS. 2 and 9, or internal to the power charge body 178, as illustrated in FIGS. 4 and 6. Either igniter placement will result in a flow-path between the actively combusting portion of the power charge 116 and the gas diverter channels 110 relatively early in the combustion process, thus enabling ample flexibility when it comes to slow-set options for setting tool 100.

According to an exemplary embodiment, FIGS. 7, 7A1, 7A2 and 7A3 as well as FIGS. 11, 13, 15 and 17, show the power charge body 178 substantially entirely disposed in a power charge container 170. Power charge container 170 may be used for any shape power charge, e.g., for power charges having round cross-section or regular polygonal cross-section, and performs a number of useful functions. For a power charge 116 that may be outside a setting tool 100 at any point, the power charge container 170 performs a safety function of preventing inadvertent chemical reaction beginning in the power charge 116. In addition, to the extent that the material forming the power charge 116 might be prone to crumbling, flaking or otherwise, the container 170 will prevent this from occurring. The material for the power charge container 170 should be rigid or semi-rigid so as to retain the desired power charge shape. Many polymers would be an appropriate choice for the container. The material and dimensions of the container 170 are selected such that the container 170 will melt or otherwise breakdown quickly when exposed to the energy (heat and pressure) generated by combustion of the power charge 116. Thus, the power charge container 170 will not impede pressurized gas generated by the power charge 116 from accessing the gas diverter channels 110.

Figure 8B:
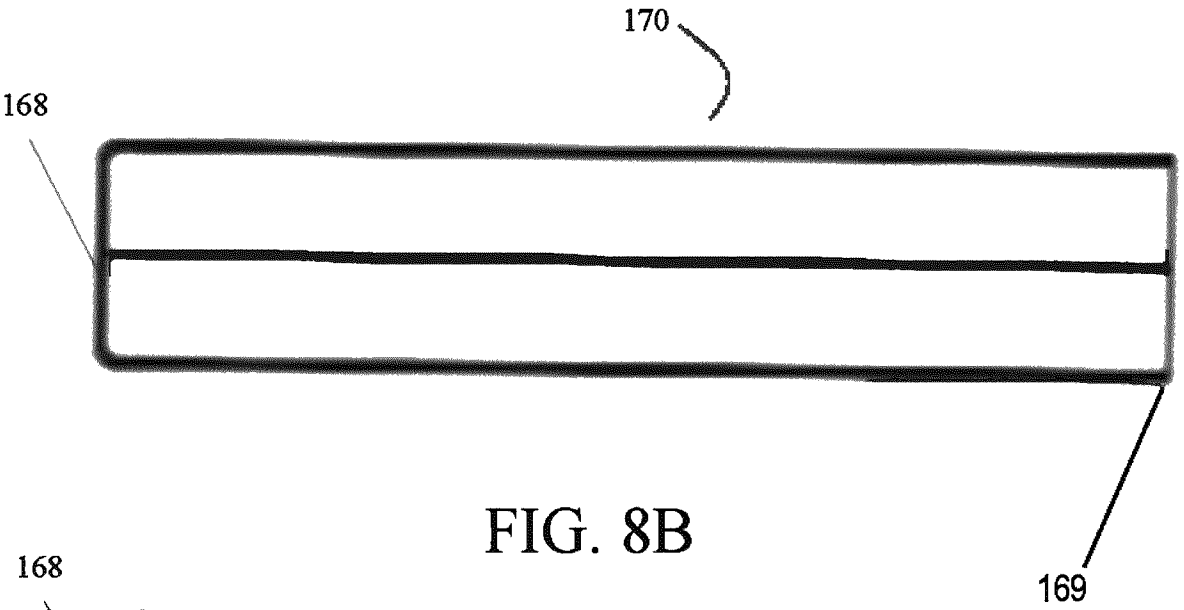
FIG. 8B is a side, plan view of the power charge container of FIG. 8A.
Figure 8C:
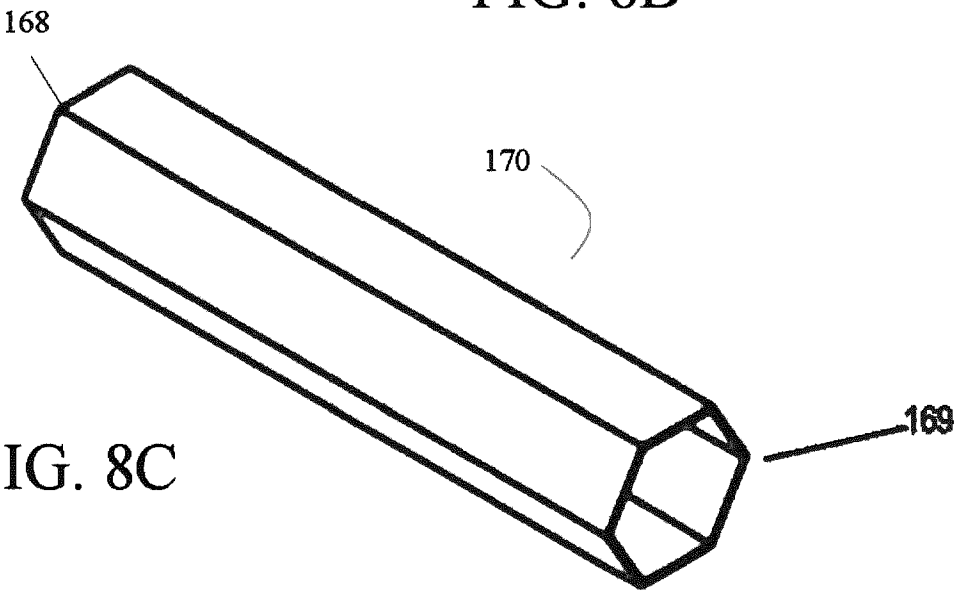
FIG. 8C is a perspective view from the side and top of the power charge container of FIG. 8A.
Figure 8A:
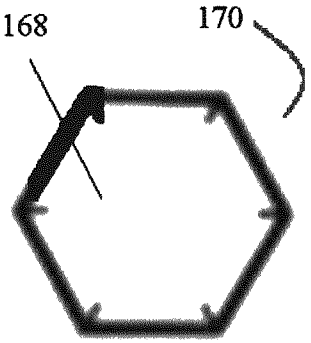
FIG. 8A is an end, plan view of a power charge container in accordance with an exemplary embodiment.

FIGS. 8A, 8B and 8C illustrate several orthographic views of an exemplary power charge container 170 having a hexagonal cross-section. FIG. 8C is a perspective view of the power charge container 170 from the side and proximal (igniter) end 169. The igniter end 169 of the power charge container 170 is open and prepared to receive a power charge 116 therein. FIG. 8B is a side, plan view of the empty power charge container 170. FIG. 8A shows an end, plan view of the distal end 168 of the hexagonal power charge container 170. Whether for shipping, storage or in use, a protective cover (not shown) may be disposed over the open igniter end 169 of the power charge container 170. Alternative to a protective cover over the igniter end of the power charge container 170, a number of structures that double as an end cap and an igniter holder are described hereinbelow.

Figure 10:
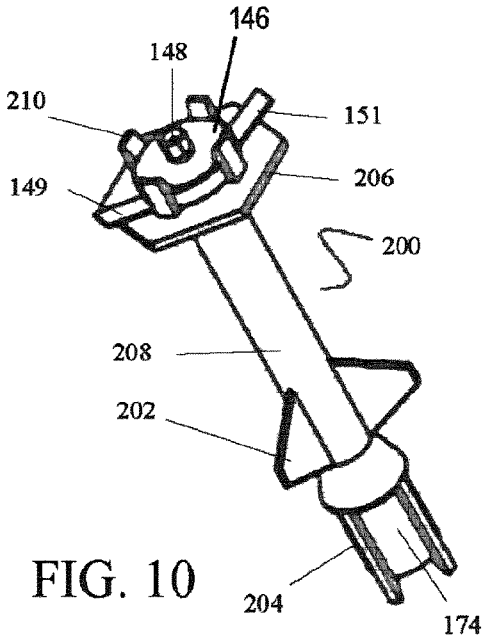
FIG. 10 is a perspective view from the side and top of an internal igniter holder according to an exemplary embodiment.
Figure 11A:
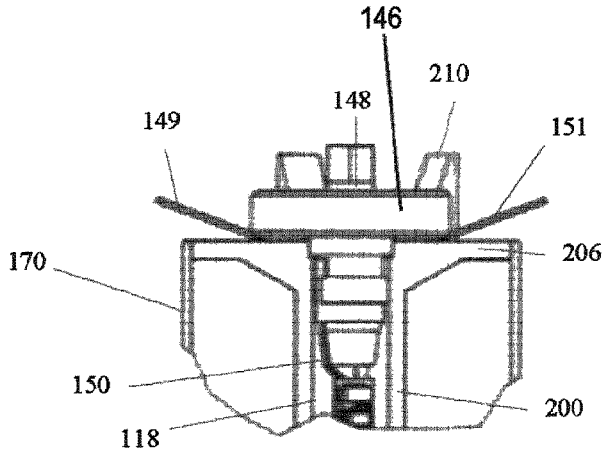
FIG. 11A is a cross-sectional, detail side view of a top portion of the internal igniter holder of FIG. 11.
Figure 11:
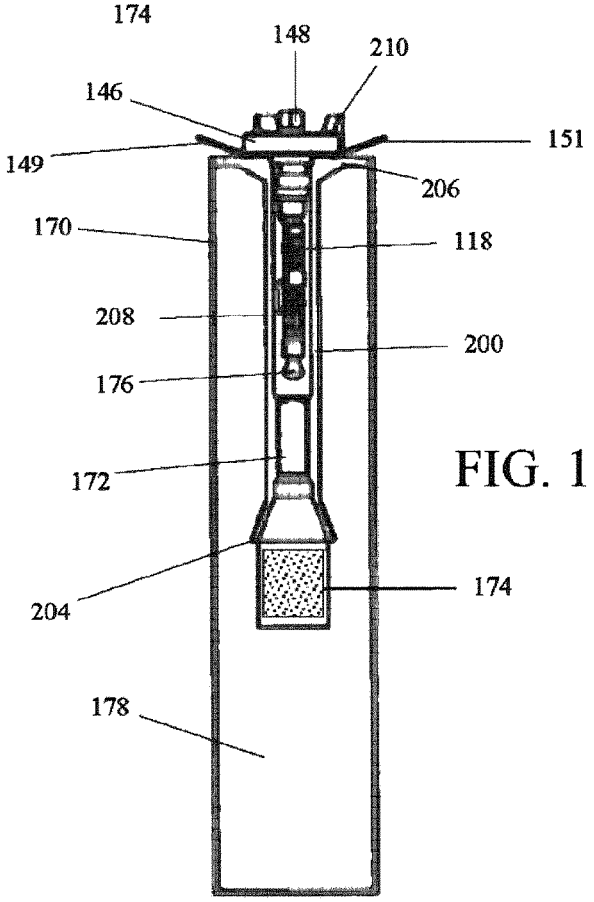
FIG. 11 is a cross-sectional, side view of the internal igniter holder of FIG. 10 inserted into a power charge according to an exemplary embodiment.

FIG. 10 illustrates an exemplary embodiment of an internal igniter holder 200 that may be inserted or integrated into the power charge body 178. FIG. 11 shows the igniter holder 200 of FIG. 10 inserted or integrated into the power charge body 178. FIG. 11A is a detailed view of the igniter end 169 of the power charge body 178, power charge container 170, igniter 118 and igniter holder 200 of FIG. 11. The igniter holder 200 has an igniter holder top 206 that may cooperate with, e.g., act as the top of, the power charge container 170 at the open igniter end 169 thereof. The igniter holder top 206 may include structures to interact with, i.e., retain, the igniter 118. For example, a set of resilient tabs 210 extending from the igniter holder top 206 may be dimensioned to receive and retain the igniter head 146. It is important that the igniter holder top 206 retain the igniter 118 such that the line-in electrical contact portion 148 of the igniter head 146 may be readily contacted to provide electricity/electrical signals to the igniter 118. According to an exemplary embodiment, an igniter shell cover 208 of the igniter holder 200 may replace the igniter shell 136 of the igniter 118. That is, the igniter 118 is integrated with the igniter holder 200 such that the igniter shell 136 is redundant to the igniter shell cover 208 and, therefore, eliminated.

Also optionally associated with either the igniter head 146 and/or the igniter holder top 206 is electrical ground connector 149. The line-in signal provided to line-in contact 148 may be passed to electronics within the igniter shell 136. The line-in signal may also be provided, simultaneously, from the igniter head 146 or igniter shell 136 to the electrical ground connector 149. The ground connector 149 may be contacted to an electrical conductor that passes a signal to another portion of the downhole tool/toolstring or act as a ground connection to the tool-string body. Similarly, a ground connector 151 is electrically connected to the igniter head 146 or igniter shell 136 and provides ground to any electronics in the igniter shell 136 in need of same. The ground connector 151 may be electrically connected to the most convenient ground source. A ground bar 150 may be included as part of the igniter holder 200. The ground bar 150 may be connected to either or both ground connectors 149, 151. When igniter 118 is inserted into the igniter holder 200, electrical contact is made between a portion of the igniter and one or both ground connectors 149, 151; electrical contact may be made between the igniter shell 136 and the ground bar 150.

Igniter holder 200 may include the igniter shell cover 208 and internal igniter holder wings 202. The igniter shell cover 208 protects igniter 118 and may also direct the reaction energy of igniter the main load 172 axially toward the distal end of igniter shell 136. Igniter holder wings 202 extend from igniter shell cover 208 and stabilize the igniter holder 200 in the power charge body 178. The wings 202 may be sized to engage the internal walls of the power charge container 170; such an arrangement may prohibit the igniter shell cover 208 from moving radially within the power charge body 178.

Another optional structure that may be associated with the igniter holder 200 is a booster holder 204. A booster charge 174 is a piece of energetic material that undergoes the same type of chemical reaction as the igniter main load 172 and the power charge body 178. The booster charge 174 is positioned close to the igniter 118 and may be of an energetic material in which the chemical/combustion reaction is easier to initiate than the energetic material of the power charge body 178. Also, the booster charge 174 may be larger and release more energy than the igniter main load 172. Thus, the booster charge 174 may enhance the ability of the combustion reaction that begins in the igniter 118 to ultimately initiate the reaction of the power charge body 178. Booster holder 204 may extend from the igniter shell cover 208 and have tabs or similar structures into which booster charge 174 may be inserted and retained adjacent the distal end of igniter shell 136 and adjacent the igniter main load 172, such that ignition of the igniter main load 172 will be passed to the booster charge 174.

Figure 12:
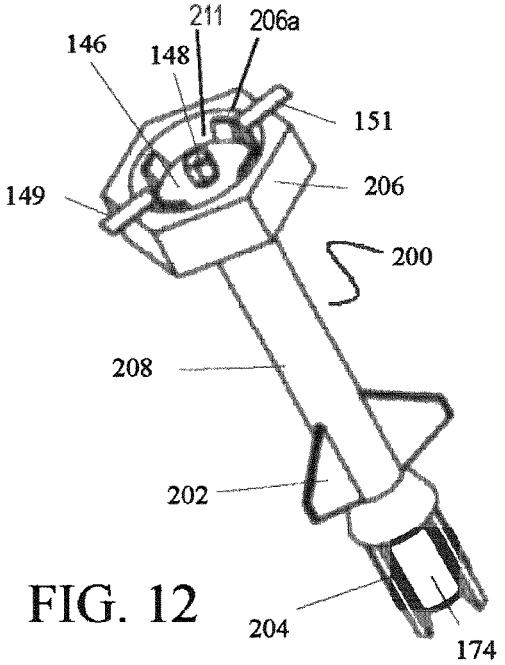
FIG. 12 is a perspective view from the side and top of an internal igniter holder according to an exemplary embodiment.
Figure 13A:
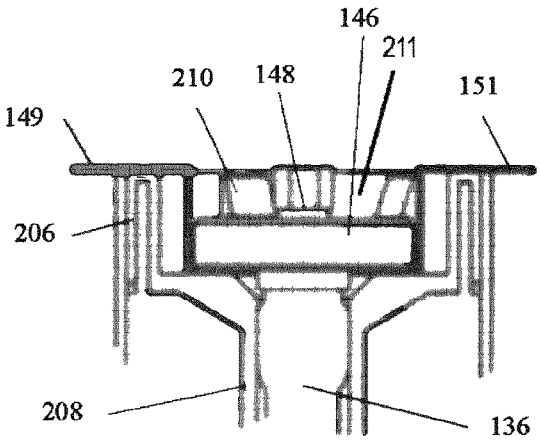
FIG. 13A is a cross-sectional, detail side view of a top portion of the internal igniter holder of FIG. 13.
Figure 13:
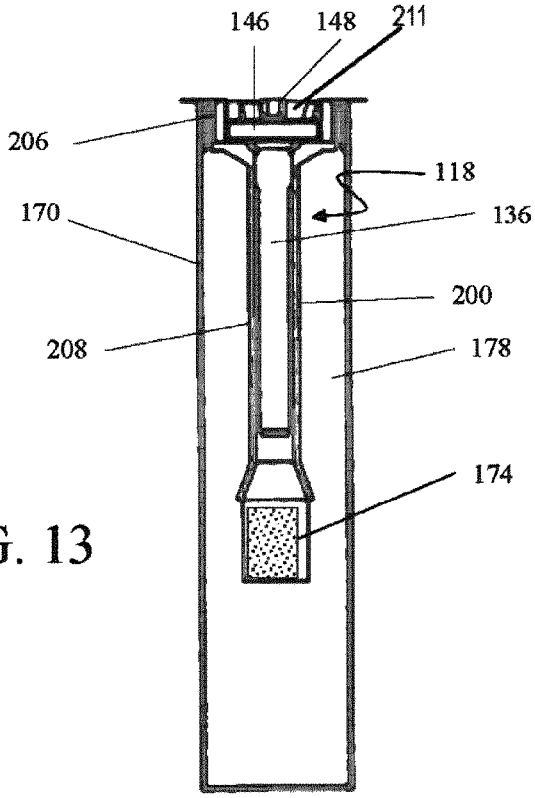
FIG. 13 is a cross-sectional, side view of the internal igniter holder of FIG. 10 inserted into a power charge according to an exemplary embodiment.
Figure 14A:
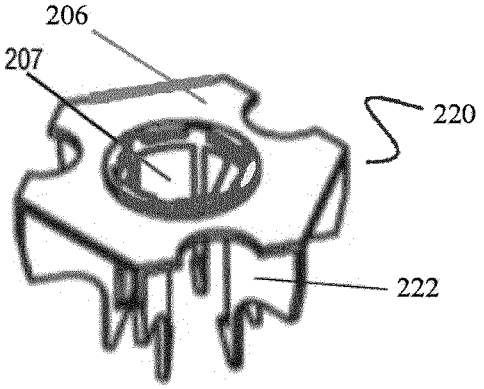
FIGS. 14A, 14B, 14C and 14D are multiple views of an igniter holder ring according to an exemplary embodiment.
Figure 14B:
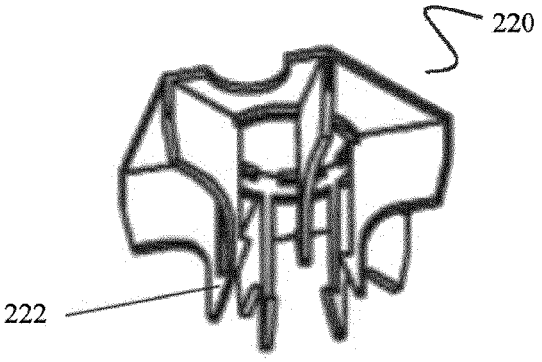
Figure 14C:
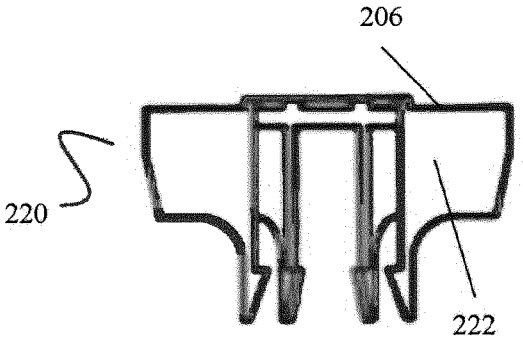
Figure 14D:
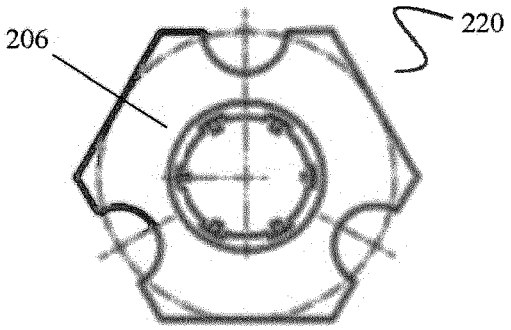

FIG. 12 illustrates another embodiment of an internal igniter holder 200 that may be inserted into the power charge body 178. FIG. 13 shows the igniter holder 200 of FIG. 12 inserted or integrated into the power charge body 178. FIG. 13A is a detailed view of the igniter end of the power charge body 178, power charge container 170, igniter 118 and igniter holder 200 of FIG. 13. The igniter holder 200 has an igniter holder top 206 that may cooperate with, e.g., act as the top of, the power charge container 170 at the open igniter end thereof. The igniter holder 200 of FIGS. 12 and 13 is different from that of FIGS. 10 and 11 in that the top 206 of the former is recessed further into the power charge container 170. This modified igniter holder top 206 has space to receive the igniter head 146 within a receptacle 211 defined by a sidewall 206*a* of the igniter holder top 206, such that the igniter head 146 is contained within the envelope of the power charge container 170, i.e., the igniter head 146 does not extend outside the power charge container 170 as does the embodiment shown in FIGS. 10 and 11.

The exemplary embodiment of an igniter holder 200 shown in FIG. 12 is substantially as described with respect to the exemplary embodiment of the igniter holder 200 shown in FIG. 10, and certain features will not be repeated here. With reference to the exemplary embodiment shown in FIG. 12, the resilient tabs 210 associated with the igniter holder top 206 are similar in form and function to those described with respect to FIG. 10. For example, the tabs 210 are dimensioned to receive and retain the igniter head 146 within the receptacle 211. The ground connector 149 and the second ground connector 151 in the exemplary embodiment shown in FIG. 12 extend straight upward to clear the height of the receptacle 211 before extending outward therefrom at a 90-degree angle. It should be noted that, merely for purposes of clarity of disclosure, the igniter shell 136 is shown intact in FIGS. 13 and 13A while it is shown in cross-section in FIGS. 11 and 11A. No difference between the igniter shell 136 or its contents in the two exemplary embodiments is necessarily implied by these illustration differences.

Figure 15:
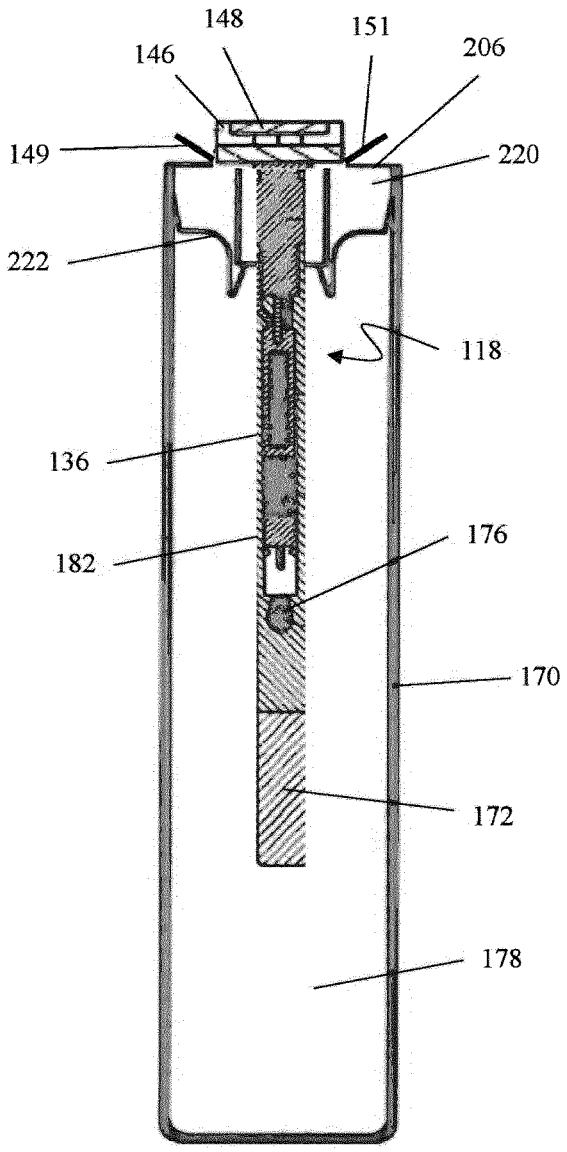
FIG. 15 is a cross-sectional, side, plan view of the igniter holder ring of FIGS. 14A, 14B, 14C and 14D and an igniter inserted into a power charge body according to an exemplary embodiment.
Figure 16:
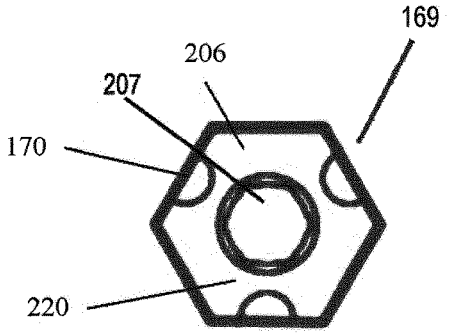
FIG. 16 is a plan view of the proximal (igniter) end of the assembly of FIG. 15 with the igniter removed.
Figure 17:
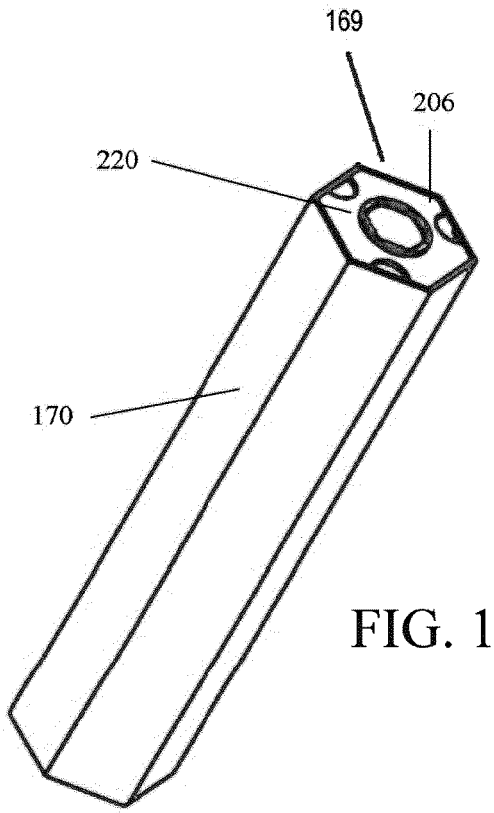
FIG. 17 is a perspective view of the power charge from the side and proximal end of the assembly of FIG. 15 with the igniter removed.
Figure 18A:
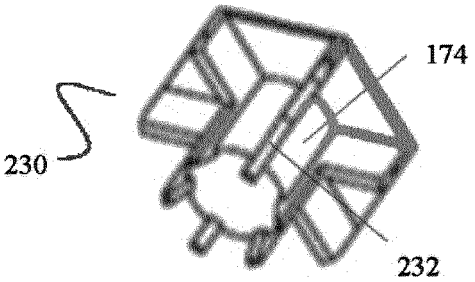
FIGS. 18A, 18B, 18C and 18D are multiple views of a booster charge holder ring according to an exemplary embodiment.
Figure 18C:
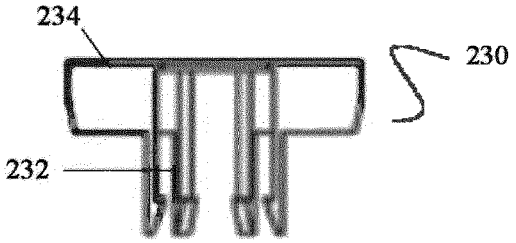
Figure 18B:
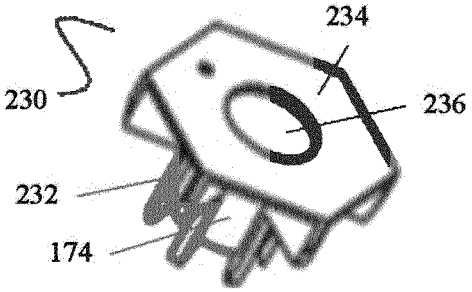
Figure 18D:
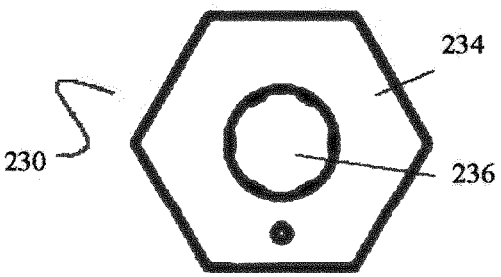

FIGS. 14A, 14B, 14C and 14D are several views of an internal igniter holder ring 220. This embodiment of an internal igniter holder may be inserted or integrated into the power charge body 178 but is shorter than the embodiments shown in FIGS. 10 and 12 and therefore extends a shorter distance into the power charge body 178 than the exemplary embodiments of FIG. 10 and FIG. 12. FIG. 15 shows the igniter holder ring 220 of FIG. 14 inserted into the power charge body 178 also having an igniter 118 inserted through the igniter holder ring 220 and into the power charge body 178. FIG. 16 is a plan view of the igniter end 169 of the power charge body 178 with an igniter holder ring 220 inserted therein. FIG. 17 is a perspective side, igniter end 169 view of the assembly of FIG. 16.

The igniter holder ring 220 has an igniter holder top 206 that may cooperate with, e.g., act as the top of, the power charge container 170 at the open igniter end 169 thereof. The igniter holder top 206 may include structures to interact with, i.e., retain, the igniter head 146, though the embodiment(s) shown in FIGS. 14-17 do not have such structures. The igniter 118 may be held in place in the embodiment of FIG. 15 through frictional forces between igniter shell 136 and either or both of an internal bore 207 of the igniter holder ring 220 and the igniter shell space 182 in the power charge body 178. The igniter holder ring 220 has a plurality of ribs 222 that extend into the power charge body 178 and function to retain engagement with either or both of the power charge body 178 or the power charge container 170 and, thus, position and retain the igniter 118 with respect to the power charge body 178.

Also optionally associated with either the igniter head 146 and/or the igniter holder ring 220 is an electrical connector 149. The line-in signal provided to line-in contact 148 may be passed to electronics within the igniter shell 136. The line-in signal may also be provided, simultaneously, from the igniter head 146 or igniter shell 136 to the electrical connector 149. The electrical connector 149 may be contacted to an electrical conductor that passes a signal to another portion of the downhole tool/toolstring or act as a ground connection to the tool-string or tool body. Similarly, a second ground connector 151 is electrically connected to the igniter head 146 or igniter shell 136 and provides ground to any electronics in the igniter shell 136 in need of same. The second ground connector 151 may be electrically connected to the most convenient ground source.

Although the release of energy from the igniter main load 172 should be sufficient to begin combustion of the power charge body 178, it is possible to include a booster charge by inserting the booster into the igniter shell space 182 prior to inserting the igniter 118.

FIGS. 18A, 18B, 18C and 18D illustrate another exemplary embodiment of a power charge configuration. These figures show several views of a booster holder ring 230. The booster holder ring 230 includes a booster holder 232, a booster holder ring top 234 and an opening 236 in the booster holder ring top 234. The booster holder 232 may extend from an underside of booster holder ring top 234. The booster holder 232 is sized to receive and retain a booster charge 174 of the type previously discussed. This booster charge 174 may be of a material in which it is easier to begin a deflagration reaction than the material in the power charge body 178. Deflagration of the booster charge 174 releases sufficient energy sufficiently close to a portion of the power charge body 178 that the energetic material of the power charge body 178 begins a self-sustaining deflagration reaction. As also previously presented, the power charge body 178 may be disposed in a container 170 that protects and holds together the power charge body 178.

Figure 19:
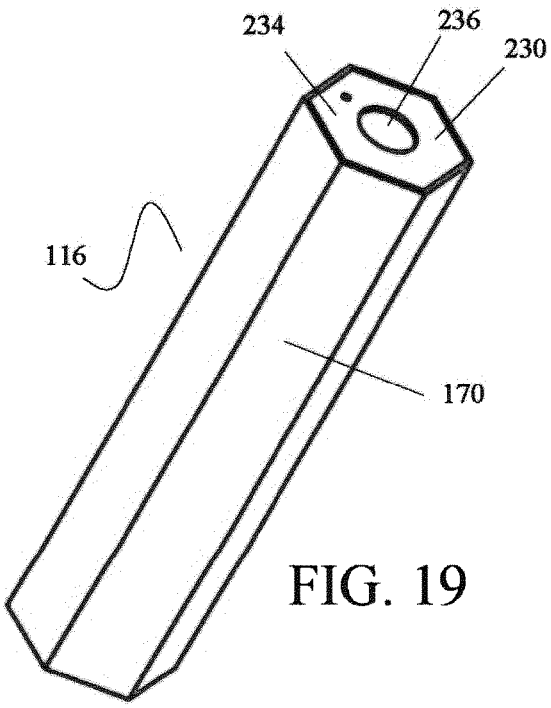
FIG. 19 is a perspective view from the side and proximal end of a power charge into which the booster charge holder ring of FIGS. 18A, 18B, 18C and 18D has been inserted according to an exemplary embodiment.
Figure 20:
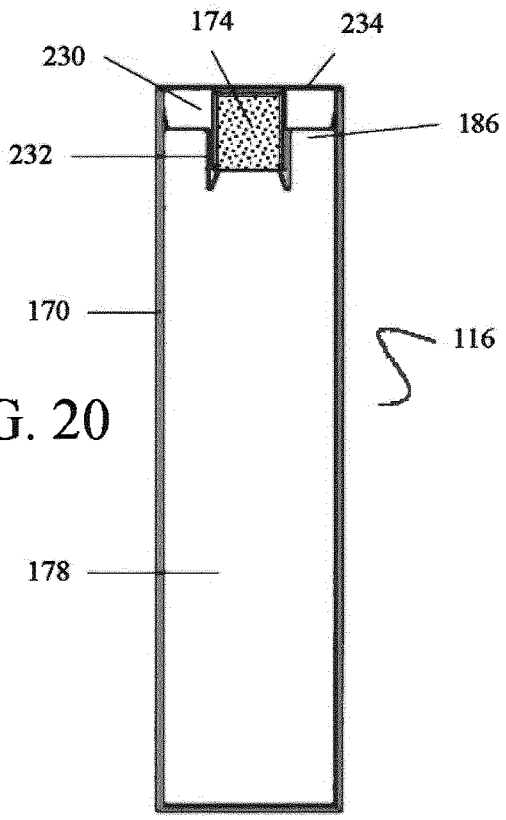
FIG. 20 is a cross-sectional, side, plan view of the power charge and booster charge holder ring of FIG. 19.

As shown in FIGS. 19 and 20, the booster holder ring 230 may be inserted into the power charge body 178 and, in the embodiment shown, be completely surrounded but for the holder ring top 234 by the energetic material of the power charge body 178. The booster holder ring 230 may be retained in place by engaging the power charge body 178 and/or the power charge container 170. In an embodiment and as shown in FIGS. 19 and 20, the booster holder ring top 234 may function as the top of the power charge container 170.

The booster holder ring 230 functions to retain a booster 174 in close proximity to the energetic material at the proximal end 186 of the power charge 116. In an embodiment, the power charge 116 having a booster holder ring 230 may be disposed in a setting tool such that an igniter 118 is held adjacent the booster holder ring 240, similar to the arrangement of the igniter 118 and power charge 116 shown in FIG. 2 and FIG. 9. More specifically, the igniter 118 may be held such that the main load 172 thereof is adjacent the opening 236 in the booster holder ring 230 and, thus, a top surface of the booster 174. In such an arrangement, the energy released by the main load 172 will start a deflagration reaction in the booster 174 which is then carried to the power charge body 178.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A power charge for actuating a tool in a wellbore, the power charge comprising:

a power charge body comprising energetic material, the power charge body defining a polygonal volume and having a proximal end and a distal end, the power charge body also having an interior space extending from the proximal end toward the distal end, and a cross-sectional shape of the power charge body along a plane perpendicular to a longest axis of the power charge body is a regular polygon;

an igniter holder positioned in the power charge body at the proximal end, the igniter holder comprising an igniter holder top including a plurality resilient tabs; and an igniter comprising an igniter head and an igniter shell, wherein the igniter head is retained by the plurality of resilient tabs, the igniter head is configured to receive an electronic signal and the igniter shell contains a fuse head configured to receive the electronic signal from the igniter head either directly or via an electrical relay, wherein the igniter holder occupies the interior space of the power charge body such that an igniter shell space of the power charge substantially encompasses the igniter except for a surface of the igniter head configured to receive the electronic signal.

2. The power charge of claim 1, wherein the fuse head includes a pyrotechnic material and wherein the electronic signal is sufficient to ignite the pyrotechnic material.

3. The power charge of claim 1, wherein the interior space includes an enlarged space configured to encompass the igniter holder top and expose the surface of the igniter head configured to receive the electronic signal.

4. The power charge of claim 1, wherein the interior space and the igniter holder extend approximately 15% to 75% of a length of the power charge body.

5. The power charge of claim 1, wherein the interior space and the igniter holder extend substantially the entirety of a length of the power charge body.

6. The power charge of claim 1, further comprising:

a power charge container configured to contain the power charge.

7. A wellbore tool comprising:

a power charge disposed in a power charge cavity, power charge comprising a body of energetic material defining a center axis, wherein the body has a proximal end and a distal end, and an indentation formed at the proximal end;

an igniter holder positioned in the power charge body at the proximal end, the igniter holder comprising an igniter holder top including a plurality of resilient tabs configured for retaining an igniter within the igniter holder;

an expansion chamber; and a fluid flow path from the power charge cavity to the expansion chamber.

8. The wellbore tool of claim 7, further comprising:

a diverter channel forming at least a portion of the fluid flow path from the power charge cavity to the expansion chamber.

9. The wellbore tool of claim 7, wherein the igniter further comprises:

an igniter head and an igniter shell, the igniter head being retained by the plurality of resilient tabs and configured to receive an electronic signal and the igniter shell containing a fuse head, the fuse head configured to receive the electronic signal through the igniter head either directly or via an electrical relay.

10. The wellbore tool of claim 9, wherein the igniter extends from the proximal end of the body toward the distal end of the body, approximately 15% to 75% of a length between the proximal end of the body and the distal end of the body.

11. The wellbore tool of claim 9, wherein the igniter extends from the proximal end of the body toward the distal end of the body, substantially the entirety of a length between the proximal end of the body and the distal end of the body.

12. The wellbore tool of claim 9, wherein the igniter is offset from a surface of the proximal end of the power charge.

13. The wellbore tool of claim 9, wherein a gap extends between the igniter and the power charge.

14. A power charge for actuating a tool in a wellbore, the power charge comprising:

a power charge body comprising energetic material, the power charge body defining a volume and having a proximal end and a distal end, the power charge body also having an interior space extending from the proximal end toward the distal end;

an igniter configured to receive an electrical signal and ignite a fuse head; and an igniter holder directly attached to the proximal end of the power charge body, wherein the igniter holder comprises an igniter holder top including a plurality of resilient tabs configured to hold the igniter inside the interior space of the power charge body; and a booster charge positioned in the igniter holder, wherein the booster charge is adjacent a main explosive load of the igniter and spaced apart from the energetic material.

15. The power charge of claim 14, wherein the booster charge is configured to burn as a result of the burning of the main explosive load and add energy to the fuse head ignition.

16. The power charge of claim 14, wherein the igniter comprises an igniter shell configured such that the burning of its contents results in a deflagration reaction in the power charge.

17. The power charge of claim 14, wherein the power charge body has a cross-sectional shape, and the cross-sectional shape is a regular polygon formed on a plane perpendicular to a longest axis of the power charge body.

18. The power charge of claim 14, further comprising:

a power charge container configured to contain the power charge.

* * * * *